US006394569B1

(12) United States Patent
Zeman

(10) Patent No.: US 6,394,569 B1
(45) Date of Patent: May 28, 2002

(54) INK JET PRINTER METHOD OF PROVIDING AN IMAGE ON A RECEIVER SO THAT THE IMAGE HAS REDUCED GRAININESS

(75) Inventor: Robert E. Zeman, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/182,720

(22) Filed: Oct. 29, 1998

(51) Int. Cl.[7] ..... B41J 2/205; B41J 2/17
(52) U.S. Cl. ..... 347/15; 347/98
(58) Field of Search ..... 347/15, 96, 98, 347/105, 106, 101

(56) References Cited

U.S. PATENT DOCUMENTS

| | | | | |
|---|---|---|---|---|
| 4,614,953 A | | 9/1986 | Lapeyre | |
| 4,630,076 A | * | 12/1986 | Yoshimura | 347/43 |
| 4,694,302 A | * | 9/1987 | Hackleman et al. | 347/96 |
| 5,045,864 A | * | 9/1991 | Light | 347/105 |
| 5,126,193 A | * | 6/1992 | Light | 428/327 |
| 5,134,667 A | | 7/1992 | Suzuki | |
| 5,339,170 A | | 8/1994 | Fan | |
| 5,491,558 A | | 2/1996 | Hamilton et al. | |
| 5,617,123 A | | 4/1997 | Takaoka et al. | |
| 6,015,620 A | * | 1/2000 | Schwarz, Jr. | 428/411.1 |

FOREIGN PATENT DOCUMENTS

JP 4031140253 * 6/1991

* cited by examiner

*Primary Examiner*—John Barlow
*Assistant Examiner*—Michael S. Brooke
(74) *Attorney, Agent, or Firm*—Norman Rushefsky

(57) ABSTRACT

Method of providing an image on a receiver, so that the image has reduced graininess. The method comprises providing a print head having a plurality of segments. A first one of the segments is capable of applying a spreading agent onto the receiver at specified locations. The spreading agent disperses (i.e., migrates) only over a predetermined area of the receiver. The remaining segments are capable of applying ink to the receiver after the spreading agent is applied to the receiver. The ink overlays the spreading agent. As the ink overlays the spreading agent, the ink is dispersed therein by action of the spreading agent. In this manner, graininess, which otherwise appears in a conventionally generated ink jet image, is reduced while sharpness of the image is maintained.

16 Claims, 4 Drawing Sheets

INK JET PRINTER METHOD OF PROVIDING AN IMAGE ON A RECEIVER SO THAT THE IMAGE HAS REDUCED GRAININESS

BACKGROUND OF THE INVENTION

The present invention generally relates to ink jet printer methods and more particularly relates to an ink jet printer method of providing an image on a receiver, so that the image has reduced graininess.

An ink jet printer produces images on a receiver by ejecting ink droplets onto the receiver in an imagewise fashion. The advantages of non-impact, low-noise, low energy use, and low cost operation in addition to the capability of the printer to print on plain paper are largely responsible for the wide acceptance of ink jet printers in the marketplace.

However, a major obstacle to achieving photographic quality with ink jet printer technology continues to be granularity, the perception of which is referred to as "grain." This deficiency is caused by the need to write discrete drops of ink as approximations to a "true" (e.g., silver halide) continuous-tone photograph, which contains no inherent "structure" (i.e., granularity) in the recording paper. Because of its inherent particulate nature, ink jet technology injects more "structure" into its reproduction of images. This structure introduces noise and visual patterns, which can be visible despite sophisticated noise suppression processing techniques. In its attempt to match the smooth, grain-less images of silver halide, ink jet technology typically employs well-known techniques, such as spatial dithering via screening or error diffusion, which remove noise from visually sensitive low spatial frequencies and place it at higher frequencies. These techniques can suppress image-content noise, but the fundamental drop size (and consequently the spot size on the receiver) remains quite visible and generally can not be hidden by algorithms. A prior art technique is to use ever smaller drop sizes to overcome this problem. However, this prior art technique invites other difficulties, such as greater print head fabrication challenges, higher likelihood of nozzle contamination and failure as nozzle size shrinks, reduced yield of acceptable print heads with all nozzles capable of firing, greater mechanical precision required in drop placement and paper advance, and higher overall print head fabrication costs. Moreover, when designing a photographic system there should be a balance between graininess and sharpness. This is also true in ink jet technology. Sharp-edged dots can provide excellent text and line rendition; however, graininess is now enhanced as well. Soft-edged dots can have their tails overlapped to achieve smoothing of uniform density areas, but text and fine detail reproduction are blurred by this technique. Ideally, a photographic ink jet system should have dots of both profiles.

U.S. Pat. No. 5,764,252 describes a method for altering density of ink drops before ejection to provide images having density levels of varying intensity. This does not, however, eliminate the previously mentioned dot structure, which causes image graininess.

U.S. Pat. No. 5, 617,123 discloses a method to vary number of drops per receiver spot, which in turn alters spot size to achieve more density levels, but this technique does not fundamentally change spot morphology.

Therefore, there is a need to provide an ink jet printer method of providing an image on a receiver, so that the image has reduced graininess.

SUMMARY OF THE INVENTION

An object of the present invention is to provide a method of providing an image on a receiver, so that the image has reduced graininess.

With this object in view, the present invention resides in a method of providing an image on a receiver, so that the image has reduced graininess, comprising the step of providing a print head having a first segment capable of applying a liquid spreading agent and a second segment capable of applying an image forming liquid to the receiver, the spreading agent being applied to the receiver before the image forming liquid is applied to the receiver, so that the image forming liquid overlays the spreading agent and so that the image forming liquid is dispersed by action of the spreading agent.

As will be described below, the present invention allows adjacent dots on the receiver to spread and flow together, thereby drastically reducing any dot-like structure or appearance thereof and promoting a grain-less or continuous tone appearance instead. The invention also maintains image sharpness as the dots spread and flow together.

A feature of the present invention is the provision of a print head having a first segment capable of applying ink spreading agent and a second segment capable of applying a liquid ink to the receiver, the spreading agent being applied to the receiver at a plurality of image-wise specified locator positions before the ink is applied to the receiver at the locator positions, so that the ink overlays the spreading agent and so that the ink is thereafter dispersed by action of the spreading agent.

An advantage of the present invention is that use thereof reduces graininess in a conventionally generated ink jet image, while maintaining sharpness present in the image.

Another advantage of the present invention is that use thereof reduces sensitivity of the ink jet printing process to produce visible banding as caused by irregular print head or receiver transport motions.

Still another advantage of the present invention is that use thereof reduces and can even eliminate streaking caused by clogged nozzles or misdirected ink jets.

Yet another advantage of the present invention is that use thereof reduces and can even eliminate need for interleaving or "nozzle averaging" when writing images thereby yielding faster printing.

Still another advantage of the present invention is that use thereof permits use of larger drop sizes (e.g., about 10–15 picolitres).

These and other objects, features and advantages of the present invention will become apparent to those skilled in the art upon a reading of the following detailed description when taken in conjunction with the drawings wherein there are shown and described illustrative embodiments of the invention.

BRIEF DESCRIPTION OF THE DRAWINGS

While the specification concludes with claims particularly pointing-out and distinctly claiming the subject matter of the present invention, it is believed the invention will be better understood from the following description when taken in conjunction with the accompanying drawings wherein:

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figure 1:
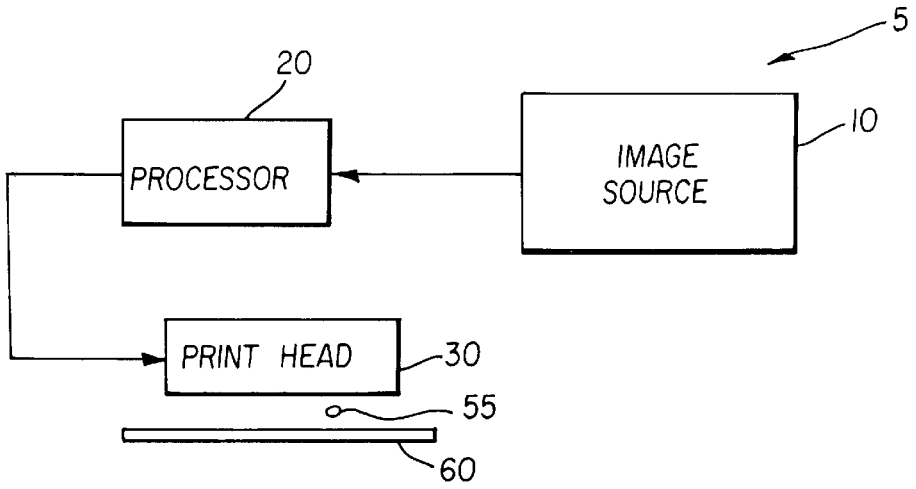
FIG. 1 illustrates a functional block diagram of a printer usable with the invention.

Therefore, referring to FIG. 1, there is shown a printer 5 comprising a digital image source 10 having image data therein to be supplied to an image processor 20. Image processor 20 converts the image data into an ink drop pattern, which pattern is transmitted to a multi-color (e.g., six-color) print head 30 (see FIG. 3).

Figure 2A:
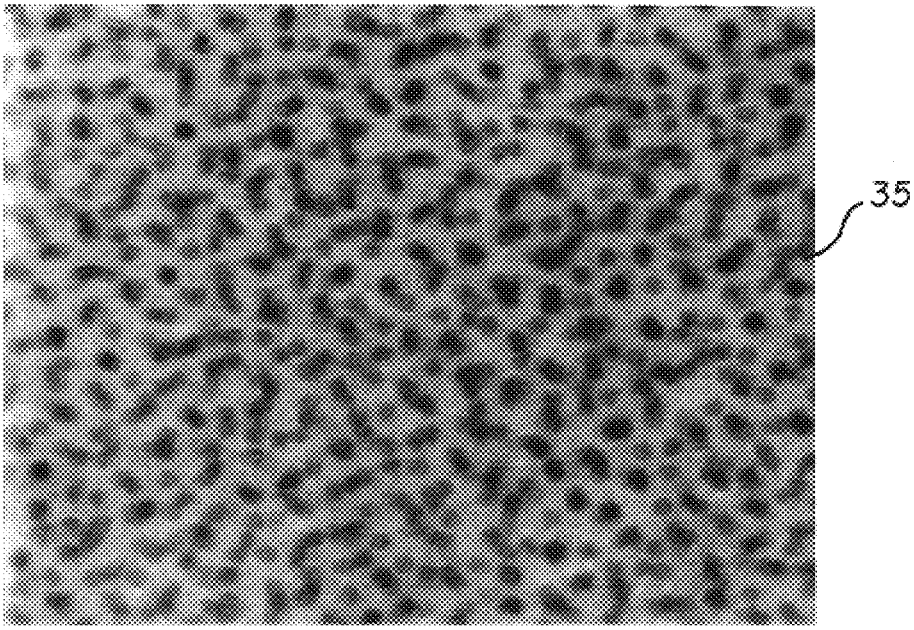
FIG. 2A (PRIOR ART)
FIG. 2A is a photo-micrograph of an area of uniform density produced by a prior art ink jet technique.
Figure 2B:
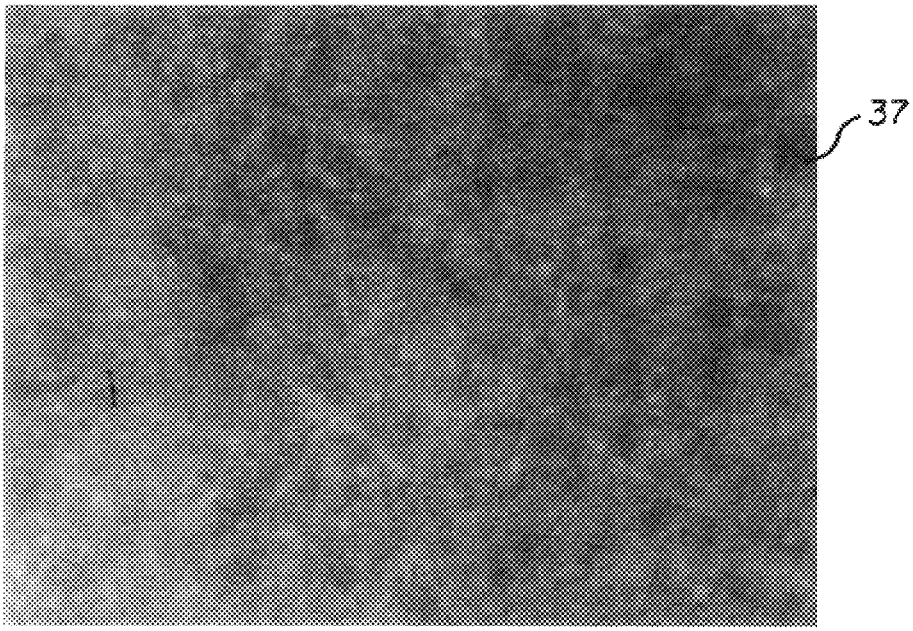
FIG. 2B is a photo-micrograph of the area of FIG. 2A but produced by practice of the present invention.

For purposes of comparison, FIG. 2A represents a 42× photo-micrograph enlargement 35 of a uniform image area as reproduced by a prior art technique and FIG. 2B represents a similar photo-micrograph enlargement 37 of a reproduction of the same area as practiced by the present invention.

Figure 3:
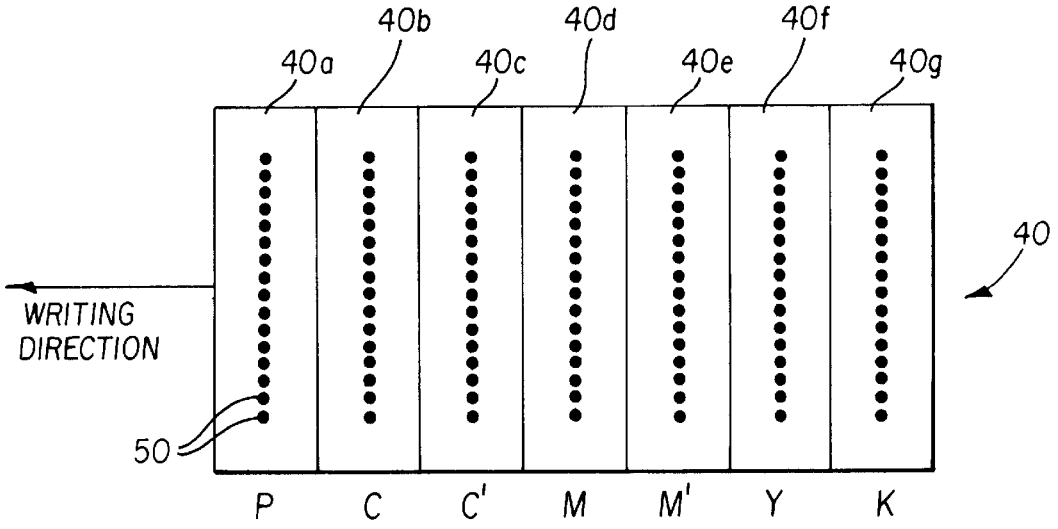
FIG. 3 is a plan view of a print head belonging to the printer, the print head capable of ejecting a spreading agent and ink droplets.

Referring to FIGS. 2 and 3, print head 30 may comprise a plurality of segments 40*a* through 40*g* (i.e., seven segments). Respective ones of segments 40*b*–40*g* are assigned a predetermined color ink to be ejected therefrom. Segments 40*a* is assigned to eject a spreading agent, for reasons described hereinbelow. Also, each of the segments 40*a*–40*g* includes a plurality of ejection nozzles 50 capable of ejecting a plurality of droplets 55 therefrom toward a receiver 60. First segment 40*a*, designated "P" for precursor, ejects droplets 55 of a clear spreading agent in any desired pattern onto receiver 60. In this regard, the spreading agent coats receiver 60 in such a manner that subsequent image forming ink drops are spatially dispersed, as described more fully hereinbelow. Moreover, the spreading agent may be water-based, a surfactant, a fluorosurfactant, a glycol, or blends thereof. The spreading agent also may be any of the following compositions: alcohol-based; alkane-based; and paraffinic-based. Of course, segments 40*b*–40*g* eject ink drops that are dispersed by the spreading agent.

Figure 4:
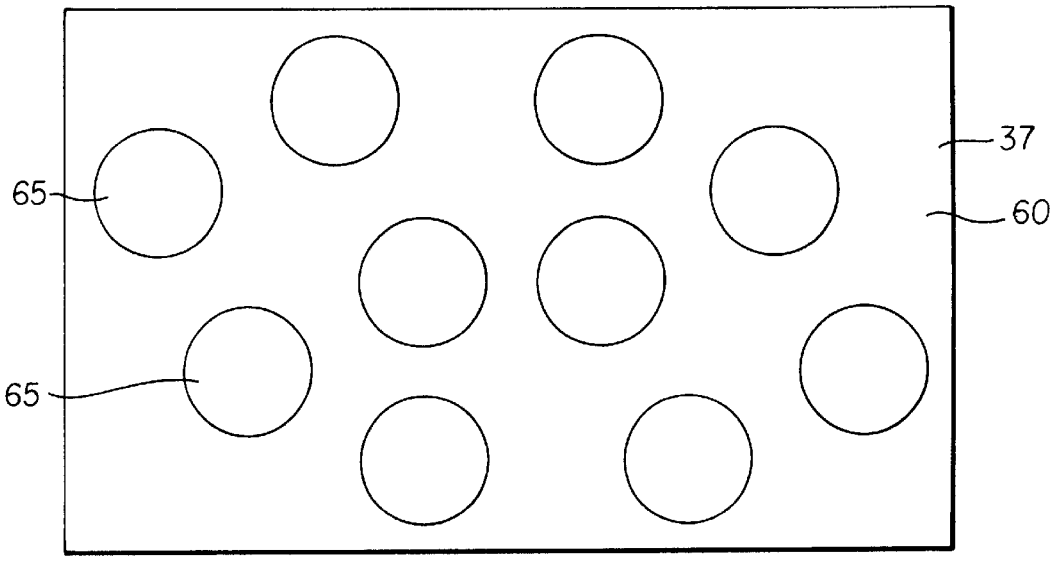
FIG. 4 is a magnified view of a receiver with ink droplets and without an ink spreading agent such that an image formed thereon will have graininess.
Figure 5:
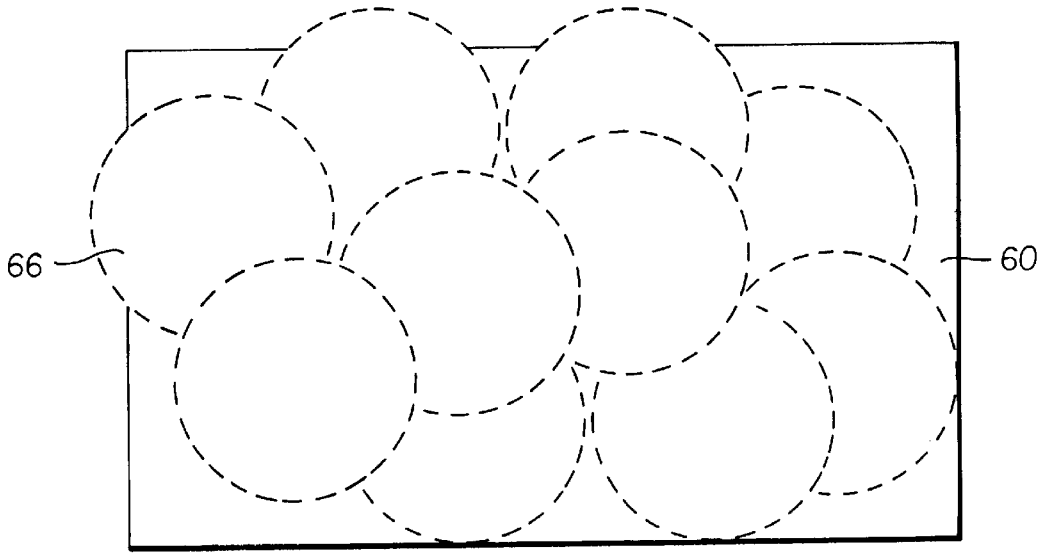
FIG. 5 is a magnified view of the receiver having the ink droplets overlaid onto the spreading agent such that an image formed thereon has reduced graininess.
Figure 6:
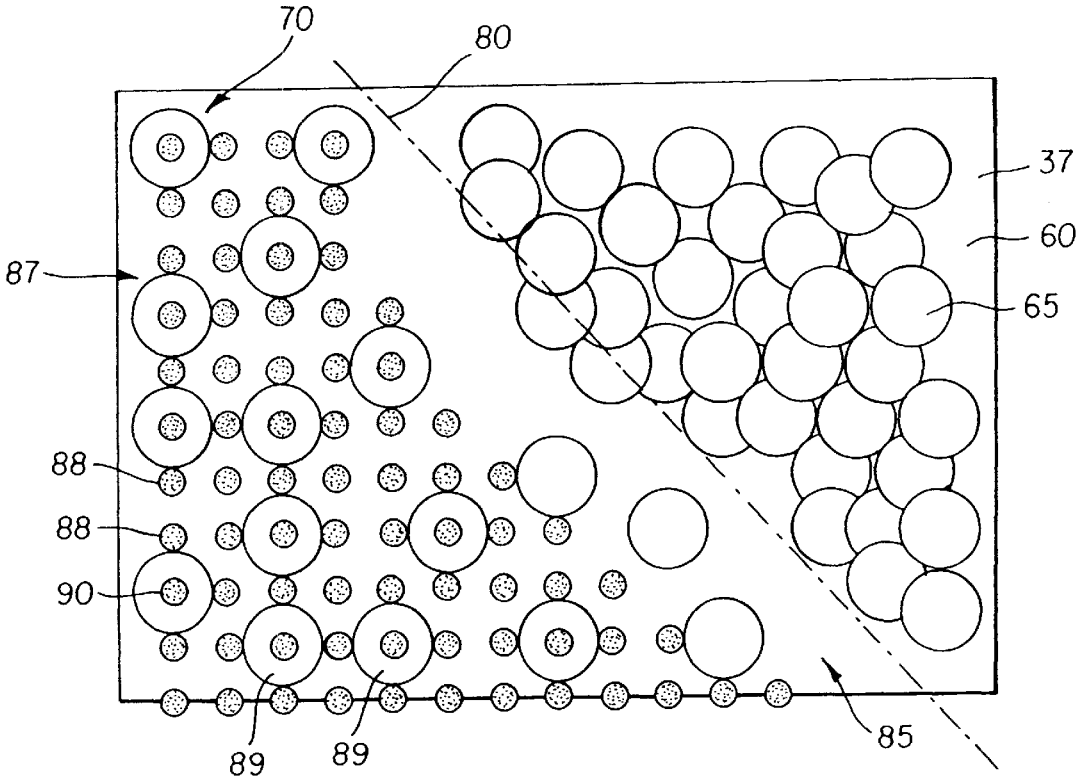
FIG. 6 shows two differing adjacent image areas separated by a boundary.

Referring to FIGS. 4, 5 and 6, image processor 20 preprocesses the image by any of a number of methods known in the art. For example, image processor 20 may preprocess the image by blurring to thereby determine an area 70 suitable for grain reduction. As defined herein, "blurring" means processing the digital image by sequentially examining values of adjacent image elements (i.e., pixels) and determining thereby the size and shape of a multi-element image area that is essentially uniform and then equalizing all image elements in the defined area. As clearly seen in FIG. 4, ink drops 65 have been deposited onto receiver 60 without the spreading agent having been used. Moreover, FIG. 5 shows the spreading of the same pattern of ink drops as shown in FIG. 4, due to the action of the spreading agent. This spreading of the pattern as shown in FIG. 5 is referred to herein as the "smoothed pattern". Also, in FIG. 6, image processor 20 determines an image edge location 80 and any other image areas, such as an area 85, in which application of the spreading agent is to be avoided. The information provided by image processor 20 creates a pattern 87 for lay-down of the spreading agent in a grain reduction area 70. The amount of spreading agent applied to receiver 60 may be varied for proportionally varying dispersal of the ink. As described presently, pattern 87 is defined by a plurality of locator positions 88.

Referring to FIG. 6, print head 30 is advanced relative to receiver 60, by means well-known in the art, and print head 30 is then activated at a desired time such that nozzles 50 of first segment 40*a* eject the spreading agent onto receiver 60 according to the afore-mentioned pattern 87. The spreading agent coats receiver 60 centered at locator positions 88. Each droplet of spreading agent has initial area 90 shortly before impacting receiver 60. After impact, the spreading agent tends to spread-out from each locator position 88 to form a substantially uniform film or layer covering pattern 87.

Referring again to FIG. 6, print head 30 continues its advance relative to receiver 60. As print head 60 advances, print head 30 writes, in succession, the image forming colored inks 89 which now overlay the spreading agent according to pattern 87. The spreading agent also spatially disperses the image forming inks according to pattern 87. Of course, the colored inks are ejected from nozzles 50 belonging to respective ones of segments 40*b*–40*g* of print head 30. Moreover, it may be understood from the description hereinabove, that the ink ejected from respective ones of segments 40*b*–40*g* are also laid-down at positions other than locations defined by pattern 87 and therefore remain unaffected by the spreading agent which is absent outside pattern 87.

Figure 7:
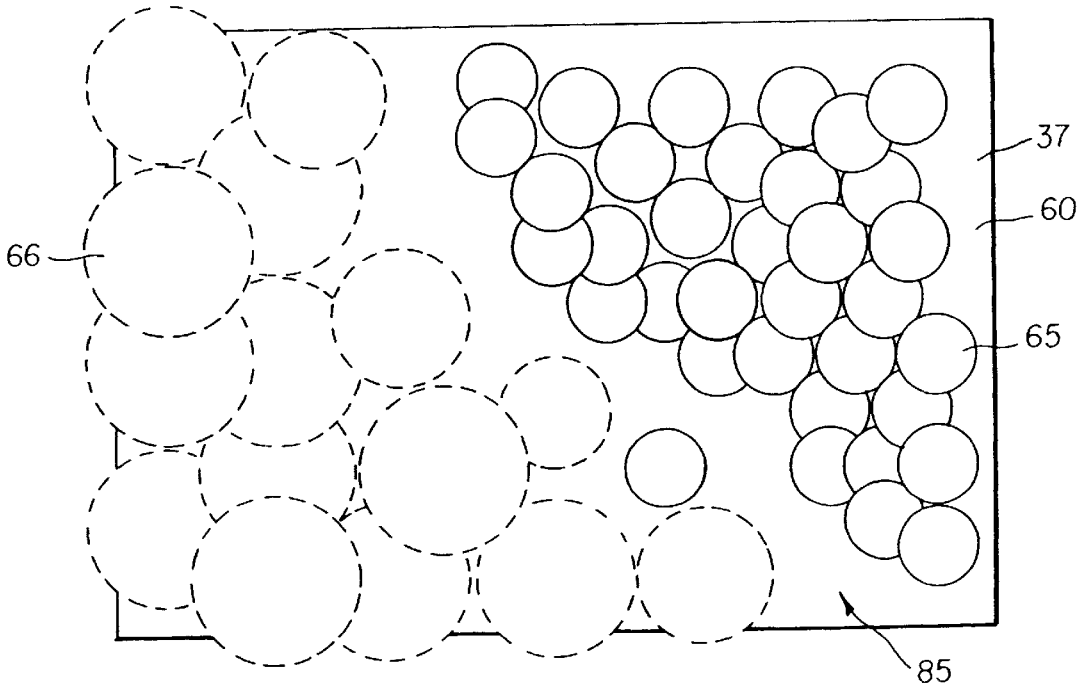
FIG. 7 shows the same two areas as shown in FIG. 6, but produced by practice of the present invention.

Turning now to FIG. 7, the ink droplets ejected into grain reduction area 70 spread-out after coming into contact with the spreading agent and obtain a lower density over a larger area than would have occurred absent the spreading agent. Each ink droplet, once coming into contact with the spreading agent, enlarges, softens its edges, overlaps neighboring ink droplets and spreads its light absorption over a larger area. These effects create a more uniform density in grain reduction area 70. In this manner, individual spots of the ink are substantially smoothed and made substantially indistinguishable to the naked eye.

It may be appreciated from the description hereinabove, that an advantage of the present invention is that use thereof reduces graininess in a conventionally generated ink jet image, while maintaining sharpness present in the image. This is so because the present invention controls blending of ink droplets ejected onto the receiver. Such blending is obtained by use of a spreading agent laid-down in a specified pattern before the ink droplets are laid-down onto the receiver.

It may be appreciated from the description hereinabove, that another advantage of the present invention is that use thereof reduces sensitivity of the ink jet printing process to produce visible banding as caused by irregular print head or receiver transport motions. This is so because the smoothing or blending distance as practiced in the invention typically covers this defect (i.e., banding).

It may be appreciated from the description hereinabove, that still another advantage of the present invention is that use thereof reduces and can even eliminate streaking caused by clogged nozzles or misdirected ink jets. This is also true because the smoothing or blending distance typically covers this defect size.

It may be appreciated from the description hereinabove, that yet another advantage of the present invention is that use thereof reduces and can even eliminate need for interleaving or "nozzle averaging" when writing images thereby yielding faster printing. This is so because the smoothing or blending technique of the present invention obviates need for multiple passes of the nozzles. This in turn is so because the smoothing or blending technique already effectively blends output droplets of adjacent nozzles.

It may be appreciated from the description hereinabove, that another advantage of the present invention is that use thereof permits usage of larger drop sizes (e.g., about 10–15 picolitres). In the prior art, smaller ink drops (e.g., 3–10 picolitres) are typically used in order to reduce visibility. Use of such smaller drop sizes have disadvantages. For example, (a) smaller nozzles clog more readily; (b) print head fabrication is more difficult because the smaller nozzles require tighter tolerances; (c) cleaning of such smaller nozzles is more difficult due to the smaller size of the nozzles; and (d) smaller nozzles require more nozzles, which in turn require more data to be supplied to the larger number of nozzles and results in slower printing time. However, according to the present invention, larger drop sizes can be used because individual ink drops become less visible after blending.

While the invention has been described with particular reference to its preferred embodiments, it will be understood by those skilled in the art that various changes may be made and equivalents may be substituted for elements of the preferred embodiments without departing from the invention. In addition, many modifications may be made to adapt a particular situation and material to a teaching of the present invention without departing from the essential teachings of the invention. For example, uniformly precoating the receiver with a spreading agent before bringing the receiver to the print head is one technique that may be used to obtain reduced graininess.

Therefore, what is provided is an ink jet printer method of providing an image on a receiver, so that the image has reduced graininess.

5 . . . printer
10 . . . image source
20 . . . image processor
30 . . . print head
35 . . . photo-micrograph enlargement of image area produced by prior art technique
37 . . . photo-micrograph enlargement of image area produced by practice of the present invention
40*a/b/c/d/e/f/g* . . . segments
50 . . . ink nozzles
55 . . . droplets (either spreading agent or ink)
60 . . . receiver
70 . . . grain reduction area
80 . . . image edge location
85 . . . area free of spreading agent
87 . . . pattern
88 . . . locator positions
89 . . . image forming colored inks
90 . . . area

What is claimed is:

1. A method of providing an image on a receiver, so that the image has reduced graininess, comprising: operating a pit head having a first segment that applies a liquid spreading agent onto the receiver and a second segment that applies an image forming liquid onto the receiver, the spreading agent being applied to the receiver before the image forming liquid is applied to the receiver, so that the image forming liquid overlays the spreading agent and so that the image forming liquid is dispersed by action of the spreading agent; and wherein data representing the image is analyzed to determine an area to be free of spreading agent and, in response to analyzing of the data, parts of the image area recorded on the receiver using image forming liquid are free of the spreading agent.

2. The method of claim 1, wherein the liquid spreading agent comprises a water-based spreading agent.

3. The method of claim 1, wherein the liquid spreading agent comprises a surfactant agent.

4. The method of claim 1, wherein the liquid spreading agent comprises a fluorosurfactant agent.

5. The method of claim 1, wherein the liquid spreading agent comprises a glycol.

6. The method of claim 1 and wherein the data is analyzed to determine an edge in the image and an area adjacent the edge where no spreading agent is to be applied.

7. The method of claim 1 and wherein the image forming liquid is deposited as drops and the sizes of drops of the image forming liquid are in the range of about 10–15 picoliters.

8. A method of providing an image on a receiver, so that the image has reduced graininess, comprising the steps of:

(a) processing data representing the image to identity an area of the image in which reduced graininess is sought;

(b) determining a pattern formed by a plurality of locator positions within the area in order to apply a liquid spreading agent at the locator positions; and (c) operating a print head having a first segment that applies the spreading agent onto the receiver and a second segment tat applies a liquid ink to the receiver, the spreading agent being applied to the receiver at the locator positions before the ink is applied to the receiver at the locator positions, so that file ink overlays the spreading agent and so that the ink is thereafter dispersed by action of the spreading agent; and wherein data representing the image is analyzed to determine an area to be free of spreading agent and, in response to analyzing of the data, parts of the image area recorded with ink on the receiver are free of the spring agent.

9. The method of claim 8, wherein the liquid spreading agent comprises a water-based spreading agent.

10. The method of claim 8, wherein the liquid spreading agent comprises a surfactant agent.

11. The method of claim 8, wherein the liquid spreading agent comprises a fluorosurfactant agent.

12. The method of claim 8, wherein the liquid spreading agent comprises a glycol.

13. The method of claim 8 and wherein the ink is deposited as drops and the sizes of drops of the ink are in the range of about 10–15 picoliters.

14. A method of providing an image on a receiver, so that the image has reduced graininess, comprising the steps of:

(a) preprocessing data representing the image to identify an area of the image in which reed graininess Is sought;

(b) determining a pattern formed by a plurality of locator positions within the area in order to apply a liquid spreading agent at the locator positions; and (c) operating a print head having a first segment that applies the spreading agent onto the receiver and a second segment that applies a liquid ink to the receiver, the spreading agent being applied to the receiver at the locator positions before the ink is applied to the receiver at the locator positions, so that the ink overlays the spreading agent and so that the ink is thereafter dispersed by action of the spreading agent; and where in step (a) the data represent the image is preprocessed to identify a sharp edge in the image and an area to be free of spreading agent, the area being adjacent to the sharp edge.

15. The method of claim 14 and wherein the ink is deposited as drops and the sizes of drops of the ink are in the range of 10–15 picoliters.

16. A method of providing an image on a receiver, so that the image has reduced graininess, comprising the steps of;

(a) preprocessing data representing the image to identify an area of the image in which reduced graininess is sought;

(b) determining a pattern formed by a plurality of locator positions within the area in order to apply a liquid spreading agent at the locator positions; and (c) operating a print head having a first segment that applies the spreading agent onto the receiver and a second segment that applies a liquid ink to the receiver, spreading agent being applied to the receiver at the locator positions before the ink is applied to the receiver at the locator positions, so that the ink overlays the spreading agent and so that the ink is thereafter dispersed by action of the spreading agent; and further comprising the step of varying the mount of spreading agent applied to the receiver for proportionally varying dispersal of the ink.

* * * * *